US011318593B2

(12) United States Patent
Chu

(10) Patent No.: US 11,318,593 B2
(45) Date of Patent: May 3, 2022

(54) APPARATUS AND METHOD FOR BOLTING TORQUE CONTROL WITHIN PRE-DETERMINED ROUNDS

(71) Applicant: CHINA PNEUMATIC CORPORATION, Taoyuan (TW)

(72) Inventor: Hsiu-Feng Chu, Taoyuan (TW)

(73) Assignee: CHINA PNEUMATIC CORPORATION, Taoyuan (TW)

( * ) Notice: Subject to any disclaimer, the term of this patent is extended or adjusted under 35 U.S.C. 154(b) by 407 days.

(21) Appl. No.: 16/374,309

(22) Filed: Apr. 3, 2019

(65) Prior Publication Data

US 2019/0375080 A1 Dec. 12, 2019

(30) Foreign Application Priority Data

Jun. 7, 2018 (TW) ..... 107119587

(51) Int. Cl.
*B25B 23/00* (2006.01)
*B25B 23/145* (2006.01)

(52) U.S. Cl.
CPC ..... *B25B 23/1453* (2013.01); *B25B 23/1456* (2013.01)

(58) Field of Classification Search
CPC ..... B25B 21/00; B25B 21/004; B25B 23/02; B25B 23/1453; B25B 23/1456
See application file for complete search history.

(56) References Cited

U.S. PATENT DOCUMENTS

2011/0107881 A1* 5/2011 Nelson ..... B25B 23/1453 81/470
2012/0163948 A1* 6/2012 Asamizu ..... B62D 65/06 414/590
2014/0033876 A1* 2/2014 Landrum ..... F15B 11/15 81/57.44
2019/0375080 A1* 12/2019 Chu ..... B25B 23/1475

FOREIGN PATENT DOCUMENTS

CN 107024943 A 8/2017
TW I509379 B 11/2015
TW I569923 B 2/2017
TW 201729027 A 8/2017

OTHER PUBLICATIONS

Office Action dated Aug. 31, 2020 in CN Application No. 201810577911.9 (8 pages).

* cited by examiner

*Primary Examiner* — Lee D Wilson
(74) *Attorney, Agent, or Firm* — Muncy, Geissler, Olds & Lowe, P.C.

(57) ABSTRACT

A torque control method and apparatus for bolt tightening within predetermined rounds are provided. The method includes the following steps: connecting a torque control apparatus between an air supply system and a torque tool; generating a plurality of flow sets by the torque control apparatus according to the maximum air consumption of the torque tool under loading; obtaining the highest and lowest working air pressures and the corresponding maximum and minimum torque values according to each flow set, thereby constructing a relation curve between a plurality of working air pressure values and torque values; and obtaining the maximum controlling range under a working air pressure condition that the torque tool can be normally operated according to a relation curve between a plurality of working air pressures and torque values.

10 Claims, 4 Drawing Sheets

APPARATUS AND METHOD FOR BOLTING TORQUE CONTROL WITHIN PRE-DETERMINED ROUNDS

CROSS-REFERENCE TO RELATED APPLICATION

This application claims priority from Taiwan Patent Application No. 107119587, filed on Jun. 7, 2018, in the Taiwan Intellectual Property Office, the disclosure of which is hereby incorporated by reference in its entirety for all purposes.

BACKGROUND OF THE INVENTION

1. Field of the Invention

The present disclosure relates to a technical field of torque control, more particularly to a torque control method and apparatus by using a pneumatic impact torque tool to tighten bolts within predetermined rounds.

2. Description of the Related Art

The inventor of the present application has obtained several patents related to torque control, such as Taiwan Patent Nos. I509379 and I569923.

In actual application, it is essential to switch the flow regulating knob on the pneumatic impact torque tool to regulate the amount of air input to control output torque. Therefore, when constructing a relation curve between air pressure values and torque values according to the aforementioned invention (Taiwan Patent No. I509379), it is imperative to switch the flow regulating knobs on the tool manually and individually to construct a relation curve between the highest and lowest working air pressure and the corresponding maximum and minimum torque values under different flow rate. When tightening the bolt within predetermined rounds, it is necessary yet inconvenient to depend on each target torque for bolt tightening falling on a torque interval covered by a specific flow rate and then switch to the corresponding positions of the flow regulating knobs.

Moreover, for the bolts which require high torque control accuracy, a couple of rounds are needed to achieve the target torque. Furthermore, due to the design of the impact mechanism, some tools may have poor relation curve linearity, which may also affect the control accuracy. Therefore, it is needed to propose a solution.

SUMMARY OF THE INVENTION

The present disclosure aims to provide a torque control method and apparatus for bolt tightening within predetermined rounds to overcome the aforementioned deficiencies so as to enhance the implementation and application in industries.

According to the purpose of the present disclosure, the present disclosure provides a torque control method for bolt tightening within predetermined rounds applied to the tightening operation of the pneumatic impact torque tool, including the following steps: connecting a torque control apparatus between an air supply system and a torque tool, wherein the torque control apparatus has a flow control module installed; regulating a flow regulator of the torque tool to the maximum flow, and measuring the maximum air consumption of the torque tool under loading through the torque control apparatus, wherein the torque control apparatus automatically generates plural sets of flow rate according to the maximum air consumption; using the flow control module to perform output torque calibration at different working air pressures under each flow rate, and constructing a relation curve between a plurality of working air pressure and correspondent torque values according to a first working air pressure, a first torque value which corresponds to the first working air pressure, a second working air pressure, and a second torque value which corresponds to the second working air pressure, wherein the first working air pressure is not equal to the second working air pressure; setting a tightening parameter when performing actual bolt tightening wherein the tightening parameter includes the number of bolt tightening and a plurality of target torque values corresponding to the number of bolt tightening; obtaining a plurality of actual working air pressure of the plurality of corresponding target torque values which correspond to each of the number of bolt tightening according to the relation curve between the plurality of working air pressure and torque values; and driving the torque tool to tighten a bolt within predetermined rounds by the torque control apparatus according to the actual working air pressure corresponding to the target torque values in ascending order.

Preferably, before each round of bolt tightening, the following step is included: be sure that every starting working air pressure to be set and equal to a lowest working air pressure which is able to be normally operated by the torque tool by the torque control apparatus.

Preferably, the following steps are further included when performing torque calibration: tightening the bolt directly by using the torque tool, then using a torque calibration tool to obtain a torque value when the bolt is tightened or loosened, and entering the torque value into the torque control apparatus; and simultaneously capturing an air consumption change under each flow set and the torque values corresponding to the first working air pressure and the second working air pressure through an airflow sensor in the torque control apparatus during a bolt-tightening calibration process, and storing captured data in a memory unit of the torque control apparatus for constructing the relation curve between the plurality of working air pressures and torque values under each flow set.

Preferably, the following steps are further included when performing torque calibration: driving a torque sensing device by the torque tool; and simultaneously capturing an air consumption change sensed by an airflow sensor and a torque signal sensed by the torque sensor in the torque control apparatus in a calibrating bolt-tightening process, and storing captured data in a memory unit of the torque control apparatus for constructing the relation curve between the plurality of working air pressure and torque values under each flow set.

Preferably, the following steps are included when performing torque calibration, wherein each flow set includes a plurality of air pressure intervals in ascending order: constructing a relation curve between sub-working air pressure and torque values corresponding to each air pressure interval according to the first working air pressure and the corresponding first torque value and the second working air pressure with the corresponding second torque value of each air pressure interval; and constructing the relation curve between the working air pressure and torque values according to the relation curve between the plurality of sub-working air pressure and torque values.

According to the purposes, the present disclosure further provides a torque control apparatus for bolt tightening within predetermined rounds which is connected between an air supply system and a torque tool, and a flow regulating valve of the torque tool is adjusted to the maximum flow rate. The torque control apparatus includes: an air inlet pressure monitoring module, monitoring an air pressure from an air supply system to the torque control apparatus and displaying a warning when exceeding a preset upper limit; an air pressure control regulating module including an air proportional valve to control and stabilize an air pressure outputted to a flow control module; the flow control module generating a plurality of flow sets with different flow rates according to a maximum air consumption of the torque tool under a load to drive the torque tool to operate; an air outlet pressure sensor disposed between the flow control module and the torque tool to sense an outputted working air pressure; a circuit board control module including a processing unit and a memory unit, wherein the processing unit stores a first working air pressure, a second working air pressure, a first torque value which corresponds to the first working air pressure, and a second torque value which corresponds to the second working air pressure obtained from a calibration under a pre-set high and low working air pressure according to each flow set when performing calibration; the memory unit constructs a relation curve between a plurality of working air pressure and torque values under the flow sets according to the first working air pressure, the second working air pressure, the first torque value, and the second torque value; wherein the processing unit automatically regulates air flow and working air pressure in ascending order according to a tightening parameter including the number of bolt tightening and a plurality of target torque values corresponding to the number of bolt tightening in order to control output torque at each round until the completion of the final target torque value.

Preferably, the flow control module is a combination of a plurality of magnetic valves or a combination of an automatic air flow proportional control valve and a magnetic valve, or a combination of an electric regulating valve and a magnetic valve.

Preferably, the processing unit forms the plurality of flow sets by turning on at least one of the magnetic valves, turning on a part of the magnetic valves, or turning on all the magnetic valves.

DESCRIPTION OF THE PREFERRED EMBODIMENTS

The full texts of each following embodiment are introduced to the specification of the present disclosure only as a part of a description, for instance, the technical means for constructing a relation curve between output (air pressure) values and torque values described in Taiwan patent No. I509379.

Figure 1:
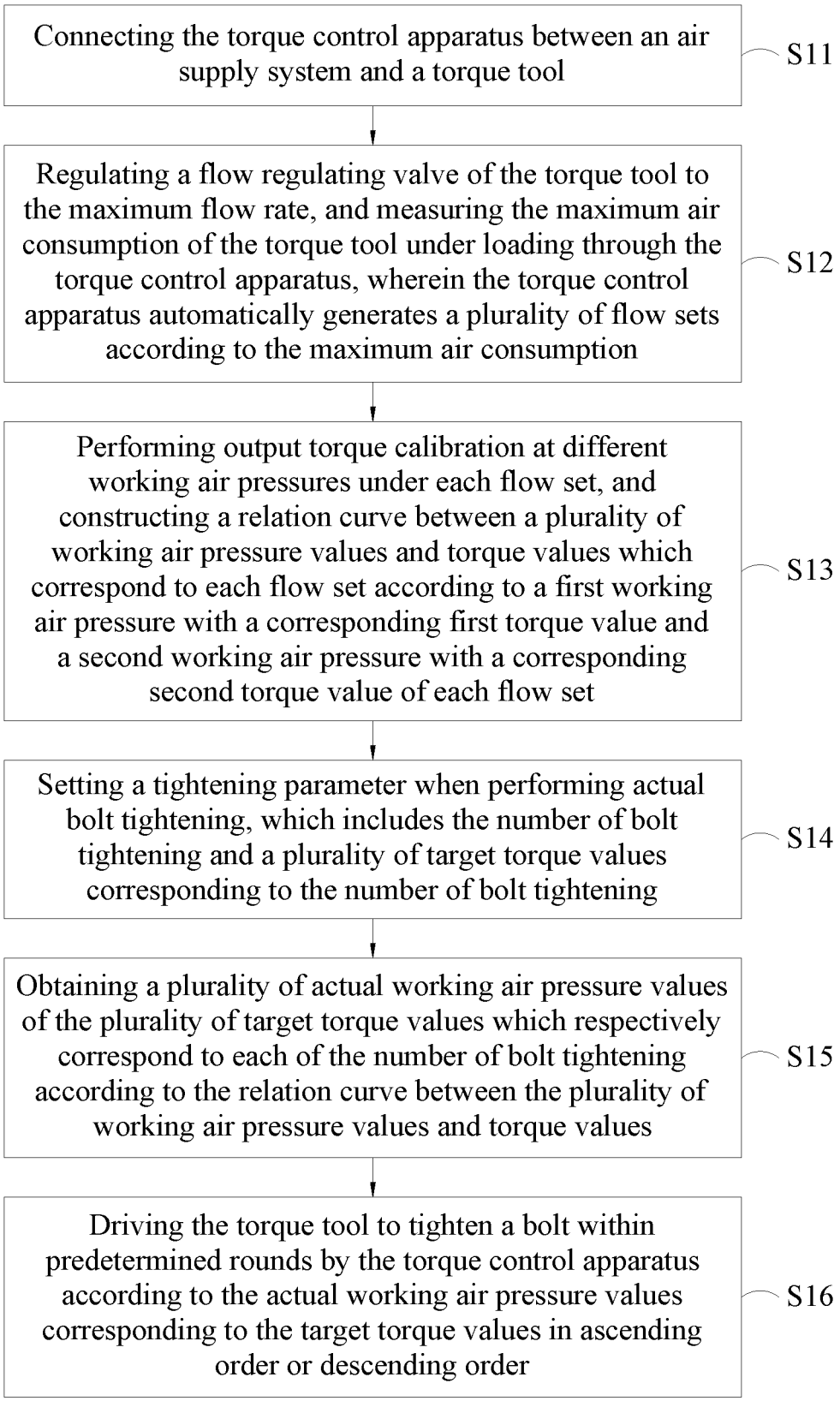
FIG. 1 depicts a step flowchart of the torque control method for bolt tightening within predetermined rounds of the present disclosure.

Please refer to FIG. 1. The torque control method for bolt tightening within predetermined rounds of the present disclosure is to be described with a pneumatic torque tool together with the torque control apparatus of the present disclosure, which includes the following steps: (S11) connecting the torque control apparatus between an air supply system and a torque tool, wherein the torque control apparatus has a flow control module installed; (S12) regulating a flow regulating valve of the torque tool to the maximum flow rate, and measuring the maximum air consumption of the torque tool under loading through the torque control apparatus, wherein the torque control apparatus automatically generates a plurality of flow sets according to the maximum air consumption; (S13) using the flow control module to perform output torque calibration at high and low working air pressures under each flow set, and constructing a relation curve between a plurality of working air pressure values and torque values which respectively correspond to each flow set according to a first working air pressure with a corresponding first torque value and a second working air pressure with a corresponding second torque value of each flow set, wherein the first working air pressure is not equal to the second working air pressure; (S14) setting a tightening parameter when performing actual bolt tightening, which includes the number of bolt tightening and a plurality of target torque values corresponding to the number of bolt tightening; (S15) obtaining a plurality of actual working air pressure values of the plurality of target torque values which respectively correspond to each of the number of bolt tightening according to the relation curve between the plurality of working air pressure values and torque values; and (S16) respectively driving the torque tool to tighten a bolt within predetermined rounds by the torque control apparatus according to the actual working air pressure values corresponding to the target torque values in ascending order or descending order.

In addition, when the torque tool is a hydraulic torque tool, the first working air pressure, the second working air pressure, and the actual working air pressure may be hydraulic pressure values.

The torque control method for bolt tightening within predetermined rounds of the present disclosure is to be described together with the torque control apparatus of the present disclosure.

Figure 2:
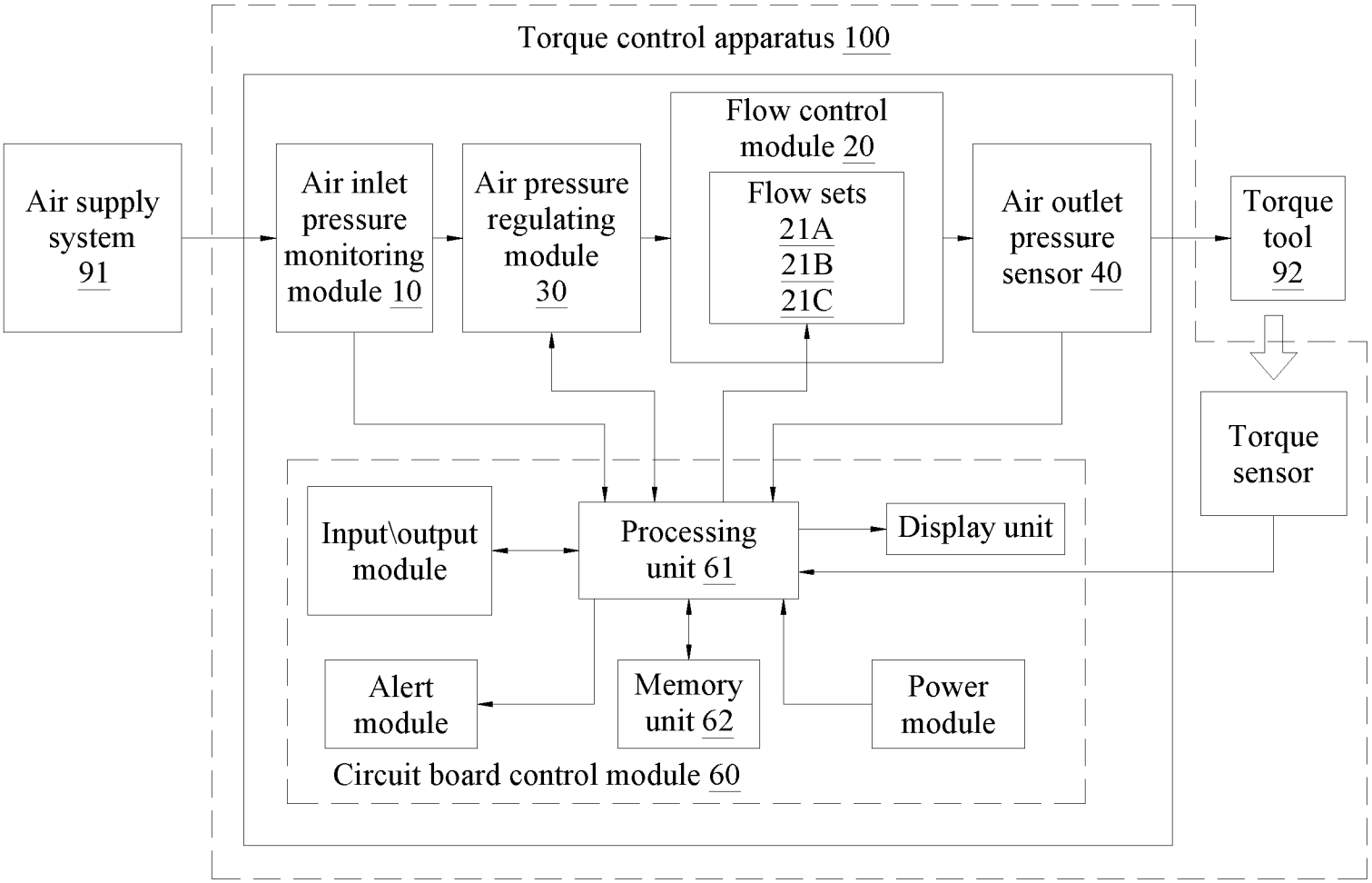
FIG. 2 depicts a block diagram of the torque control apparatus for bolt tightening within predetermined rounds according to an embodiment of the present disclosure.

Please refer to FIG. 2. The torque control apparatus 100 for bolt tightening within predetermined rounds of the present disclosure is connected to the air supply system 91 and the torque tool 92 to drive the torque tool 92 to tighten bolts from small to large gradually.

The torque control apparatus 100 includes: an air inlet pressure monitoring module 10, controlling the air pressure from the air supply system 91 to the torque control apparatus 100 and displaying a warning when an air inlet pressure exceeds a preset upper limit of the torque control apparatus 100; an air pressure control regulating module 30, controlling or regulating an air pressure outputted to a flow control module 20 by an proportional control valve, generating a plurality of flow sets 21 by a processing unit 61 according to the maximum air consumption of the torque tool 92 under loading, and selecting corresponding sets selectively according to the number of rounds for bolt tightening and the target torque value for each round; an air outlet pressure sensor 40, disposed between the flow control module 20 and the torque tool 92 to sense a working air pressure outputted to the torque tool 92 during a bolt tightening process; a circuit board control module 60, including a processing unit 61 and a memory unit 62; the memory unit 62, storing a first torque value, a second torque value, a corresponding first working air pressure, and a corresponding second working air pressure obtained from a calibration according to each flow set 21 when performing calibration; the processing unit 61, constructing a relation curve between a plurality of working air pressure values and torque values by a plurality of working air pressure and torque values stored in the memory 62 according to the tightening parameter received by the input\output unit. For instance, when in calibration, the processing unit 61 gradually tightens the bolts until the completion of the final target torque according to the relation curve between the highest and lowest working air pressure and the corresponding maximum and minimum torque values obtained from each flow set 21, predetermined rounds, the number of bolts, and the target torque values of each round in ascending order.

Specifically, before the operation, the operator first regulates the flow regulating knob of the torque tool 92 to the maximum flow position, then actuates the torque tool, and measures the maximum air consumption of the torque tool 92 under loading through the flow control module 20 of the torque control apparatus 100. In the meantime, the processing unit 61 of the circuit board control module 60 automatically generates a plurality of flow sets, namely 21A, 21B, 21C, and the like according to the maximum air consumption and the set parameter. In doing so, the flow control module 20 may be used to replace the function of the flow regulating knob of the torque tool 92, and automatically switch to the corresponding flow set and the working air pressure according to the pre-set rounds and the target torque of each round. Therefore, the operator does not need to regulate flows manually to adjust the output torque on the torque tool, which greatly enhances working efficiency and convenience of operation.

Next, the output torque calibrations are performed under each flow set, such as 21A, 21B, 21C, and the like. When in calibration, drives the torque tool 92 and the torque sensor installed at its output end to perform tightening on a test base or bolts with the operable first working air pressure and the operable second working air pressure under each of the flow sets 21A, 21B, 21C to obtain the corresponding first torque value and second torque value, for instance, the highest and lowest working air pressures and the corresponding maximum and minimum torque values.

Figure 3:
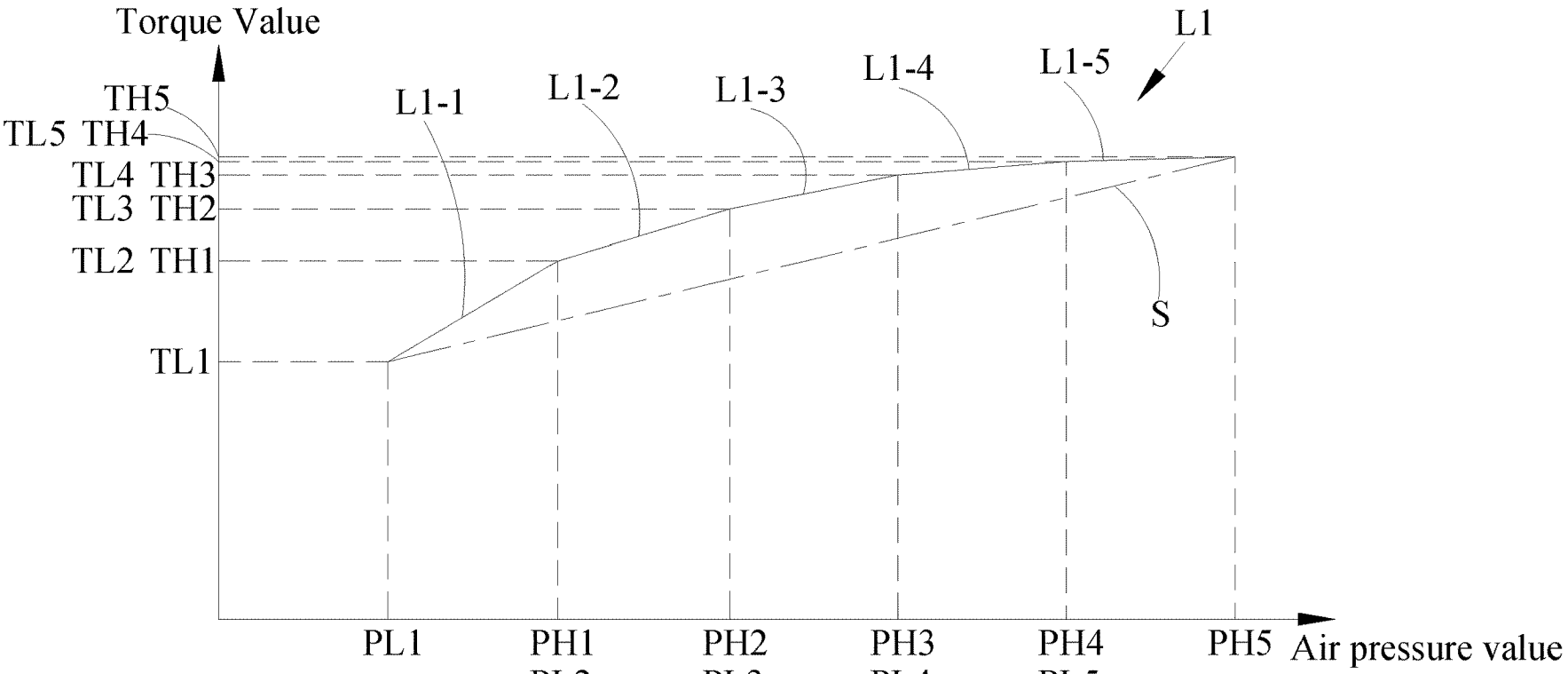
FIG. 3 depicts a schematic diagram of the approach for constructing a relation curve between air pressure values and torque values under each flow set of the torque control method for bolt tightening within predetermined rounds.

Please refer to FIG. 3, which depicts a schematic diagram of the construction of a relation curve between the highest and lowest air pressure values and the corresponding maximum and minimum torque values under each flow set of the torque control method for bolt tightening within predetermined rounds.

For instance, the flow set 21A may include a plurality of air pressure intervals in ascending order, which divides the working air pressures able to be normally operated by the torque tool from the lowest working air pressure PL1 to the highest working air pressure PH5 into five air pressure intervals. The intervals in ascending order are PL1-PH1, PL2-PH2, PL3-PH3, PL4-PH4, and PL5-PH5, wherein PH1=PL2, PH2=PL3, PH3=PL4, and PH4=PL5. TL1 is the torque value obtained from the calibration which corresponding to PL1, whereas TH2 is the torque value obtained from the calibration and corresponding to PH1. This constructs the relation curve L1-1 between the sub-working air pressure values and torque values about the highest and lowest air pressure values PL1-PH1 and the corresponding maximum and minimum torque values TL1-TH1 for the torque tool 92 in the air pressure interval (hereinafter referred to as the sub-relation curve). Next, TL2 is obtained from the calibration at a higher interval PL2. TH2 is obtained from the calibration at the interval PH2. This constructs the sub-relation curve L1-2 between the highest and lowest air pressure values PL2-PH2 and the corresponding maximum and minimum torque values TL2-TH2 for the torque tool 92 in the air pressure interval. Wherein, TL2 is equal to TH1, so the calibration for TL2 may be omitted.

According to the aforementioned description, several sub-relation curves may be obtained sequentially, namely the sub-relation curve L1-3 regarding a higher interval PL3-PH3 corresponding to TL3-TH3, the sub-relation curve L1-4 regarding a much higher interval PL4-PH4 corresponding to TL4-TH4, and the sub-relation curve L1-5 regarding the highest interval PL5-PH5 corresponding to TL5-TH5.

Afterward, a relation curve L1 between air pressure values and torque values are constructed according to these sub-relation curves. Compared with the relation curve S constructed by Taiwan Patent No. I509379, the relation curve L1 (hereinafter referred to as the relation curve) between air pressure values and torque values obtained from this method is closer to the actual situation. Each segment of the relation curves between air pressure values and the corresponding torque values constructed by this method is closer to linearity. Therefore, the torque can be controlled more precisely.

Specifically, before every tightening, the torque control apparatus 100 controls every starting working air pressure to be equal to a lowest working air pressure which is operable by the torque tool 92 to prevent the residual higher air pressure air left in the air line from affecting the tightening precision at the moment of actuation. Moreover, from inputting air into the torque control apparatus 100 to connecting the torque tool 92, it is important to prevent any changes and leakages after the calibration of the relation curves between the highest and lowest working air pressure and the corresponding torque values regardless of the size of the tube and the size and length of the air inlet/outlet connector. If any changes are required, the calibration must be redone to ensure the control accuracy.

Figure 4:
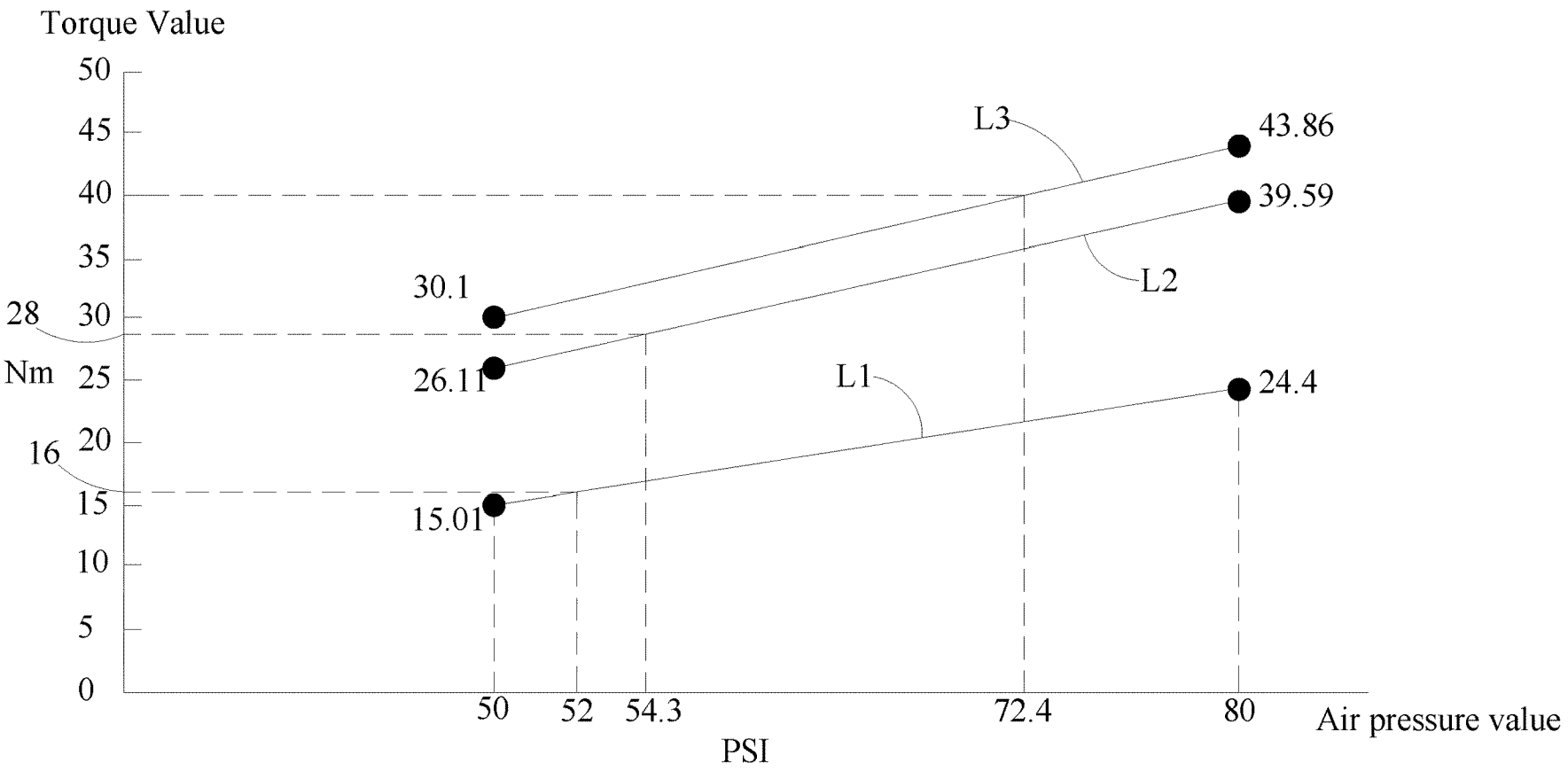
FIG. 4 depicts a schematic diagram and a relation curve between high and low air pressure values and corresponding torque values obtained from the calibration under each flow set of the torque control method for bolt tightening within predetermined rounds of the present disclosure.

Please refer to FIG. 4. As the aforementioned steps, the calibration is performed under the second flow set 21B (a flow set at one higher level) to obtain the relation curve L2 of the second flow set 21B. In this way, a plurality of relation curves under flow sets 21A, 21B, and 21C are constructed sequentially in ascending order. In this embodiment, three different sizes of flow sets are used as an example, but not limited thereto.

In this embodiment, the flow control module 20 can be a combination of an automatic flow proportional control valve and a solenoid valve or a combination of an electronic regulating valve or a magnetic solenoid valve. Wherein, the automatic flow proportional control valve or the electric regulating valve may be disposed at either end of the magnetic valve Please refer to FIG. 4 again. As shown in the figure, the relation curves L1, L2, L3 are obtained under the lowest 50 PSI and highest 80 PSI air pressure values which are operable by the torque tool 92 according to the three flow sets in ascending order, which respectively show the maximum and minimum torque value range at 15.01-24.4 NM of the first segment of the relation curve L1 obtained by calibration under the minimum flow set (230 L/min), the highest and lowest torque value range at 26.11-39.59 NM of the second segment of the relation curve L2 obtained by calibration under the flow set (500 L/min), and the maximum and minimum torque value range at 30.1-43.86 NM of the third segment of the relation curve L3 obtained by calibration under the maximum flow set (730 L/min).

The following conditions are exemplified as an example: tightening five bolts to the target torque value of 40 NM in three rounds by using the torque tool 92; setting 40% of the target torque value in the first round (That is, the first target torque value is 16 NM); setting 70% of the target torque value in the second round (That is, the second target torque value is 28 NM), and setting the target torque value of 40 NM in the third round.

To start bolting, the processing unit 61 of the circuit board control module 60 actuates the flow set 21A of the relation curve L1 according to the first target torque value. The working air pressure 52 PSI corresponding to the target torque of 16 NM in the first round is found on this relation curve. After finishing the bolting of five bolts sequentially, the flow set L2 corresponding to the target torque of 28 NM in the second round is actuated. In the meantime, the corresponding working air pressure 54.3 PSI is found on this relation curve. After finishing the bolting of five bolts sequentially, the flow set L3 corresponding to the target torque of 40 NM in the third round is actuated. In the meantime, the corresponding working air pressure 72.4 PSI is found on this relation curve. After each bolt in each round is tightened to the target torque, whether the target torque is met or not, it will be displayed immediately together with the notification of sounds. The next flow set will be automatically switched until the completion of the final target torque.

If a relation curve constructed by using the method in FIG. 3 of the present disclosure is adopted, the corresponding working air pressure may be found on the corresponding relation curves between the air pressure values and the torque values of the corresponding segment of any target torque. Compared with previous case which only roughly adopted nonlinear control curves between two points of the highest air pressure value with the maximum torque value and the lowest air pressure value with the minimum torque value, the present disclosure can find the corresponding working air pressure to the target torque more precisely and further enhance the control accuracy.

In conclusion, the torque control method and apparatus for bolt tightening within predetermined rounds of the present disclosure optimize the relation curves between two points of the maximum and minimum torque values corresponding to the highest and lowest air pressure values proposed in previous case and makes the relation curve be at a smaller air pressure interval. The relation curves between the highest and lowest air pressure values at all intervals and the corresponding maximum and minimum torque values are obtained respectively. The air pressure corresponding to the target torque of each round may be found for performing torque control on the relation curve formed by connecting each of the segments of each flow sets. The experiment proves that the torque control accuracy can be greatly improved. Moreover, the flow control module installed with the torque control apparatus of the present disclosure may be used to replace the function of the flow regulating knob of the torque tool so that the operator does not need to regulate flows manually during bolting process. The output torque can be automatically adjusted to the corresponding working air pressure on the relation curve so as to enhance working efficiency and convenience of operation.

The above description is merely illustrative rather than restrictive. Any spirit and scope without departing from the present invention as to equivalent modifications or alterations are intended to be included in the following claims.

What is claimed is:

1. A torque control method for bolt tightening within predetermined rounds applied to a tightening operation of a torque tool, the torque control method comprising the following steps:

connecting a torque control apparatus between an air supply system and a torque tool, wherein the torque control apparatus has a flow control module installed;

regulating a flow regulating valve of the torque tool to a maximum flow rate, and measuring a maximum air consumption of the torque tool under loading through the torque control apparatus, wherein the torque control apparatus automatically generates a plurality of flow sets according to the maximum air consumption;

using the flow control module to perform output torque calibration at different working air pressures under each flow set, and constructing a relation curve between a plurality of working air pressure and torque values which correspond to each flow set according to a first working air pressure which corresponds to a first torque value, a second working air pressure which corresponds to a second torque value of each flow set, wherein the first working air pressure is not equal to the second working air pressure;

setting a tightening parameter when performing actual bolt tightening, wherein the tightening parameter comprises a number of bolt tightening and a plurality of target torque values corresponding to the number of bolt tightening;

obtaining a plurality of actual working air pressure values of the plurality of target torque values which correspond to each of the number of bolt tightening according to the relation curve between the plurality of working air pressure values and torque values; and driving the torque tool to tighten a bolt within predetermined rounds by the torque control apparatus according to the actual working air pressure values corresponding to the target torque values in ascending order.

2. The torque control method according to claim 1, further comprising the following steps before each round of actual bolt tightening:

controlling every starting working air pressure to be equal to a lowest working air pressure able to be normally operated by the torque tool with the torque control apparatus.

3. The torque control method according to claim 1, further comprising the following steps when performing torque calibration:

tightening the bolt directly by using the torque tool, then using a torque calibration tool to obtain a torque value when the bolt is tightened or loosened, and entering the torque value into the torque control apparatus; and simultaneously capturing an air consumption change under each flow set and the torque values corresponding to the first working air pressure and the second working air pressure through an airflow sensor in the torque control apparatus while calibrating a bolt-tightening process, and storing captured data in a memory unit of the torque control apparatus for constructing the relation curve between the plurality of working air pressure values and torque values under each flow set.

4. The torque control method according to claim 1, further comprising the following steps when performing torque calibration:

driving a torque sensing device by the torque tool; and simultaneously capturing an air consumption change sensed by an airflow sensor and a torque signal sensed by the torque sensor under a pre-set high and low working air pressure in the torque control apparatus while calibrating a bolt-tightening process, and storing captured data in a memory unit of the torque control apparatus for constructing the relation curve between the plurality of working air pressure values and torque values under each flow set.

5. The torque control method according to claim 1, further comprising the following steps when performing torque calibration, wherein each flow set comprises a plurality of air pressure intervals in ascending order:

constructing a relation curve between sub-working air pressure values and torque values corresponding to each of the air pressure intervals according to the first working air pressure with the corresponding first torque value and the second working air pressure with the corresponding second torque value of the air pressure interval; and constructing the relation curve between the working air pressure values and torque values according to the relation curve between the plurality of sub-working air pressure values and torque values.

6. A torque control apparatus for bolt tightening within predetermined rounds connected between an air supply system and a torque tool, wherein a flow regulating valve of the torque tool is adjusted to a maximum flow, and the torque control apparatus comprises:

an air inlet pressure monitoring module, monitoring an air pressure from an air supply system to the torque control apparatus and displaying a warning when exceeding a set upper limit;

an air pressure control regulating module comprising an proportional valve to control and stabilize an air pressure outputted to a flow controlling module;

the flow control module generating a plurality of flow sets with different flows according to a maximum air consumption of the torque tool under loading to drive the torque tool to operate;

an air outlet pressure sensor disposed between the flow control module and the torque tool to sense an outputted working air pressure during a bolt tightening process;

a circuit board controlling module comprising a processing unit and a memory unit, wherein the memory unit stores a first working air pressure, a second working air pressure, a first torque value which corresponds to the first working air pressure, and a second torque value which corresponds to the second working air pressure obtained from a calibration under a pre-set high and low working air pressure according to each flow set when performing calibration; the processing unit constructs a relation curve between a plurality of working air pressure and torque values under the flow sets according to the first working air pressure, the second working air pressure, the first torque value, and the second torque value;

wherein the processing unit automatically regulates the flows and working air pressure in ascending order according to a tightening parameter comprising a number of bolt tightening and a plurality of target torque values corresponding to the number of bolt tightening in order to control outputted torque at each round until the completion of the final target torque value.

7. The torque control apparatus according to claim 6, wherein the torque control apparatus controls every starting working air pressure to be equal to a lowest working air pressure able to be normally operated by the torque tool before each round of bolt tightening.

8. The torque control apparatus for bolt tightening within predetermined rounds according to claim 6, wherein the flow control module is a combination of a plurality of magnetic valves, a combination of an automatic flow ratio regulating valve and a magnetic valve, or a combination of an electronic regulating valve and a magnetic valve.

9. The torque control apparatus for bolt tightening within predetermined rounds according to claim 8, wherein the processing unit forms the plurality of flow sets by turning on at least one of the magnetic valves, turning on a part of the magnetic valves, or turning on all the magnetic valves.

10. The torque control apparatus for bolt tightening within predetermined rounds according to claim 6, wherein each flow set comprises a plurality of air pressure intervals in ascending order; the processing unit constructs a relation curve between sub-working air pressure values and torque values corresponding to each of the air pressure intervals of each flow set according to the first working air pressure and the corresponding first torque value and the second working air pressure and the corresponding second torque value of the air pressure interval, and constructs the relation curve between the air pressure values and torque values according to the relation curve between the plurality of sub-working air pressure values and torque values.

* * * * *